US012187567B2

(12) United States Patent
Fu

(10) Patent No.: US 12,187,567 B2
(45) Date of Patent: Jan. 7, 2025

(54) TAPE DISPENSER

(71) Applicant: Guoping Fu, Shenzhen (CN)

(72) Inventor: Guoping Fu, Shenzhen (CN)

( * ) Notice: Subject to any disclaimer, the term of this patent is extended or adjusted under 35 U.S.C. 154(b) by 624 days.

(21) Appl. No.: 17/427,904

(22) PCT Filed: Feb. 2, 2019

(86) PCT No.: PCT/CN2019/074518
§ 371 (c)(1),
(2) Date: Jun. 19, 2022

(87) PCT Pub. No.: WO2020/155129
PCT Pub. Date: Aug. 6, 2020

(65) Prior Publication Data

US 2022/0234859 A1 Jul. 28, 2022

(51) Int. Cl.
*B65H 35/00* (2006.01)

(52) U.S. Cl.
CPC ... *B65H 35/0033* (2013.01); *B65H 2402/412* (2013.01); *B65H 2404/10* (2013.01)

(58) Field of Classification Search
CPC ..... B65H 35/0033; B65H 2402/412
USPC ..... 225/25
See application file for complete search history.

(56) References Cited

U.S. PATENT DOCUMENTS

| | | | | |
|---|---|---|---|---|
| 2010/0108267 | A1* | 5/2010 | Chung | B65H 35/0033 156/527 |
| 2015/0336761 | A1* | 11/2015 | Clayson | B65H 18/28 242/160.4 |
| 2017/0278598 | A1* | 9/2017 | Kerstetter | B65B 27/105 |
| 2019/0092597 | A1* | 3/2019 | Carrion | B32B 43/006 |
| 2022/0194733 | A1* | 6/2022 | Brusius | B65H 35/0033 |
| 2023/0032801 | A1* | 2/2023 | Woolman | B25F 1/04 |
| 2023/0038807 | A1* | 2/2023 | Lin | B65H 35/008 |
| 2023/0282872 | A1* | 9/2023 | Kim | H01M 10/052 29/623.1 |
| 2023/0365372 | A1* | 11/2023 | Hartgers | B65H 35/008 |
| 2024/0034590 | A1* | 2/2024 | Biernath | B65H 35/0033 |
| 2024/0083706 | A1* | 3/2024 | Dahill | B65H 35/0073 |

* cited by examiner

*Primary Examiner* — Omar Flores Sanchez

(57) ABSTRACT

A tape dispenser comprises a main body, a blade, and an adhesive portion provided with a pressure-sensitive adhesive on a surface thereof. The adhesive portion is mounted below the blade and protruded from the main body. After a tape is cut by the blade, the adhesive portion contacts and adheres to the back of the tape's end so as to prevent the tape's end from flapping freely or unintentionally sticking back to the original location. At the next use, the adhesive portion can press the tape's end onto an object that needs to be taped.

3 Claims, 8 Drawing Sheets

TAPE DISPENSER

BACKGROUND OF THE INVENTION

The invention relates to the field of hand-held tools, and more particularly to a tape dispenser.

In the packaging industry, a hand-held tape dispenser is widely used for sealing corrugated boxes or other objects. The tape is a roll-shaped tape coated with adhesive on single side, and held on the tape dispenser. The coated side of the tape is called the front side, and the non-adhesive side is called the back side. When in use, the tape's end is pulled out and attached to the object to be taped. The operator holds the tape dispenser with one hand and pulls it backwards, so that the tape roll could be forced to rotate to slowly release the tape. After one operation, the tape can by cut by the blade located at the front of the tape dispenser. However, there are a lot disadvantages in the prior art: after the tape is cut, due to the internal stress of the tape itself and the complicated external environment, and the tape dispenser's complex movement during the operation process, all these interferences cause the tape's end to flap or stick back. The sticky surface of the tape may stick to other parts or the tape roll itself, so a lot of effort will be made at the next use to find the tape's end and stick it to the object to be taped.

Some solutions in the prior art disclose that the use of an electrostatic adsorption member on the tape dispenser can attract the back of the tape, so that the tape's end will not flap to stick back. But in fact, products on the market that claim to have such electrostatic adsorption function have almost completely failed to achieve the proposed effect. The reason is that the simple structure of the tape dispenser is difficult to generate enough static electricity. Secondly, even if it can generate weak static electricity, it is highly possible to neutralize. Static electricity is made by the accumulation of single-polarity charges due to charges' transfer. If a part of the tape dispenser is positively charged, another part must be negatively charged. It is easy to neutralize each other. Moreover, when the tape dispenser is in contact with the object to be taped and the human body, it may neutralize with it, so it is difficult to form a stable charge accumulation. Even if it can maintain a short-time charge accumulation, its static electricity will definitely disappear after a few hours or a few days. Thus at the next time you use it, you still need to make extra effort to find and straighten the tape's end. And, using of a tape dispenser is often an intermittent operation, so there is an urgent need for a method that can stably and lastingly prevent the tape's end from flapping or sticking back. Thirdly, even if it can generate weak static electricity, it is difficult to achieve sufficient strength to grip the tape's end, because the tape's end has gravity and internal stress by deformation. And the using environment is complicated that the tape dispenser swings back and forth during operation and is littered the workplace; all these various interferences make it very high possible to cause the tape's end to flap freely or unintentionally stick back to the original location.

A large number of prior art are developed around the above-mentioned "electrostatic weak adsorption" idea, and have not jumped out of this circle.

SUMMARY OF THE INVENTION

In order to solve the above-mentioned defects in the prior art, the inventor of the present patent, after careful observation and extensive testing, proposes a solution that uses Pressure-sensitive adhesive to directly stick to the back of the tape's end, which could be called the "strong adhesion" solution compared to the "electrostatic weak adsorption" solution in the foregoing prior art. The present invention includes a main body and a knife. The main body is provided with a tape-holding portion for accommodating or holding a tape roll which can be rotated to release the tape; the blade is provided on the main body to contact and press the tape when the tape dispensation is completed, so as to cut it off. The difference between the present invention and the prior art is that the present invention also includes an adhesive portion provided with a pressure-sensitive adhesive on a surface thereof. The adhesive portion is mounted below the blade and protruded from the main body. After a tape is cut by the blade, the adhesive portion contacts and adheres to the back of the tape's end so as to prevent the tape's end from flapping freely or unintentionally sticking back to the original location. At the next use, the adhesive portion can press the tape's end onto an object that needs to be taped.

The back of the tape is smooth, and the pressure-sensitive adhesive sticks to the back of the tape's end and then peels off in the next operation of dispensing. It can still maintain a certain adhesive force after repeated cycles of long-term constant operation. The present invention uses the characteristic of pressure-sensitive adhesive, and improves the structure or construction of the tape dispenser.

The advantages achieved by the present invention are: the pressure-sensitive adhesive can stick to the tape's end stably and lastingly, and prevent the tape's end from flapping freely or unintentionally sticking back. After use, even if it is left for several hours or even several days until next time use, the stuck state can still be maintained. In the next time operation, the tape's end will remain in the state and position it was cut off last time, that is, the adhesive side is facing outside, so the operator can hold the tape dispenser and directly press the tape's end against the object to be taped, without the necessity to try hard to find the tape's end or pull it out by hand. The tape dispenser has a simpler structure and is more convenient, especially smooth and easy during continuous operation, to use.

DETAILED DESCRIPTION OF EMBODIMENTS OF THE INVENTION

Hereinafter, the structural embodiment of the present invention will be described in detail with reference to the accompanying drawings.

Figure 1:
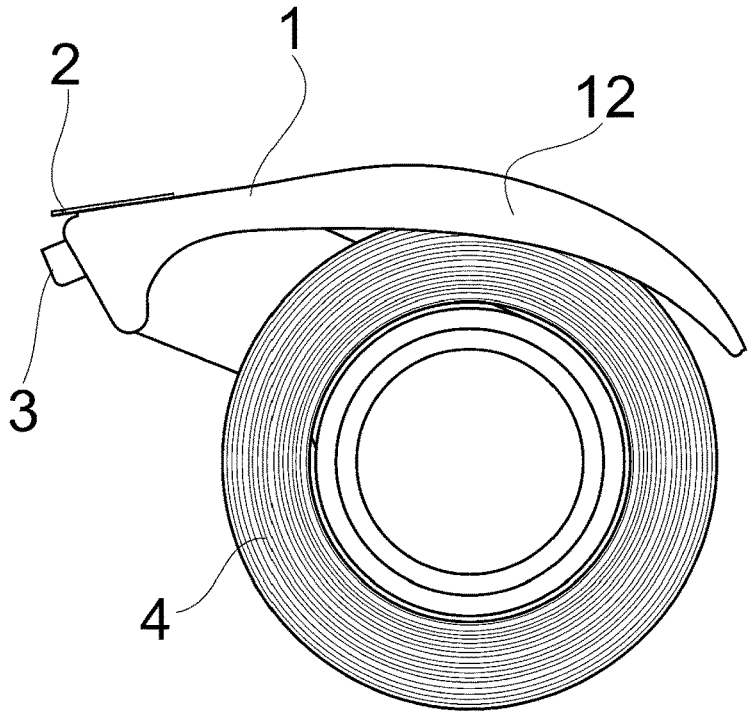
FIG. 1 is a front view of a basic embodiment of the present invention (the first embodiment)
Figure 2:
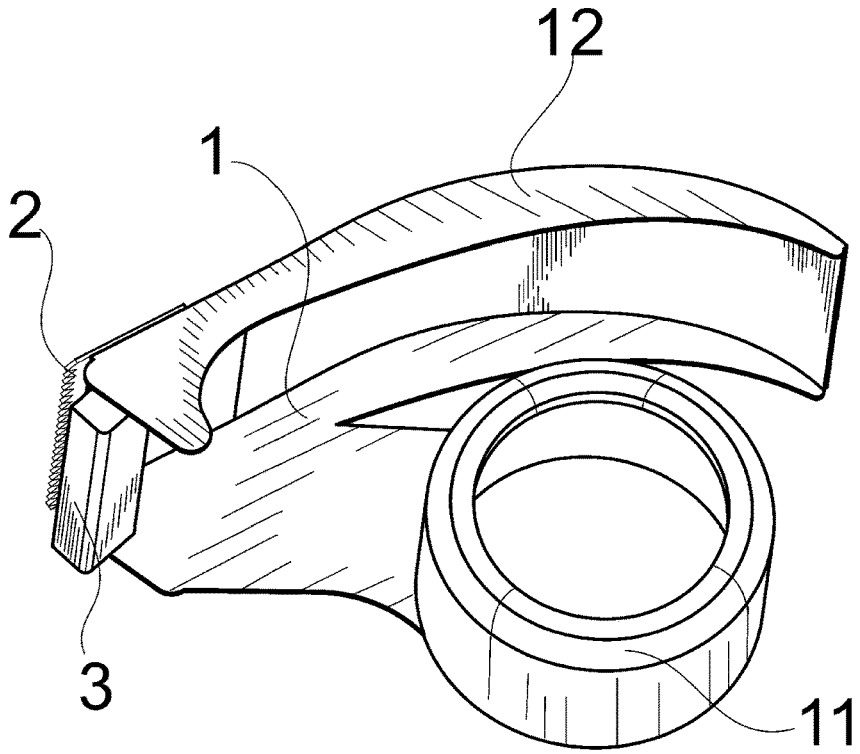
FIG. 2 is a perspective view of the embodiment shown in FIG. 1.
Figure 3:
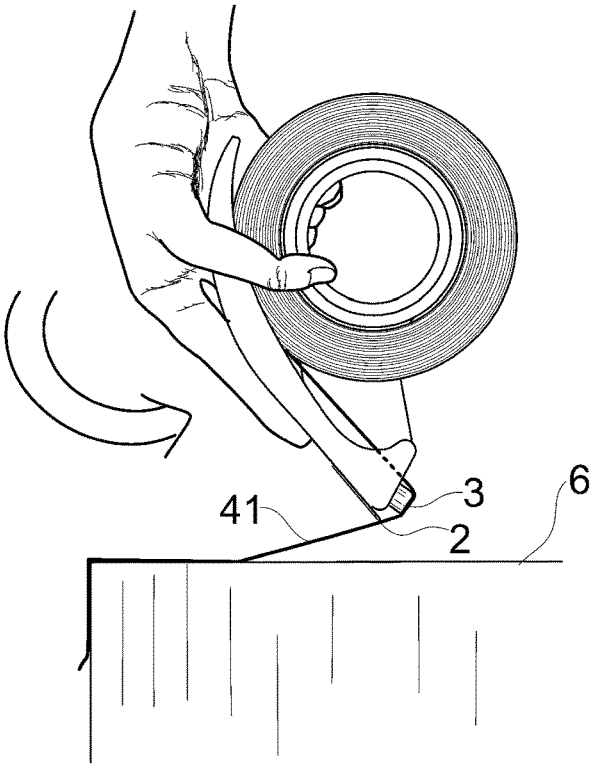
FIG. 3 is a schematic diagram of the use state of the embodiment shown in FIG. 1.
Figure 4:
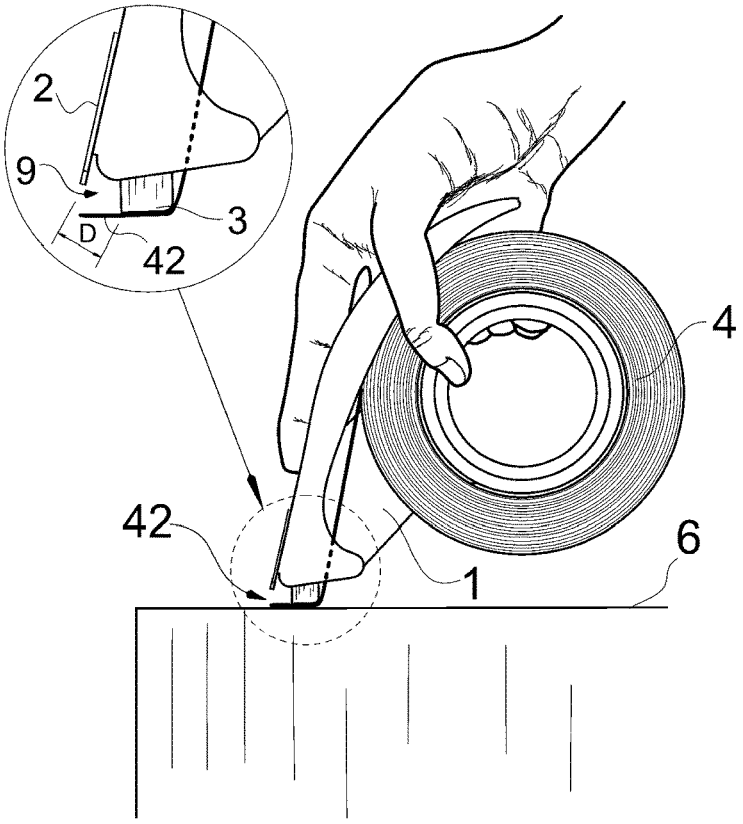
FIG. 4 is another schematic diagram of the use state of the embodiment shown in FIG. 1.

FIG. 2 is a perspective view of a basic embodiment of the present invention, and FIG. 1 is a front view (with the tape roll 4 installed). The tape dispenser of this embodiment includes a main body 1, a blade 2 and an adhesive portion 3. The main body 1 is further provided with a tape-holding portion 11 which is an annular hollow boss for holding a tape roll 4; the tape roll 4 can be rotated around the hollow boss to release the tape; the main body 1 further includes a portion for grip 12 which covers the outer edge of the tape roll 4 to prevent it from falling off; The portion for grip 12 and the other part of the main body 1 are usually connected by hinge to achieve relative rotation (the hinge structure is not illustrated in the figure), so that it can support tape rolls of different sizes. The blade 2 is arranged on the main body 1, and is usually a blade with a jagged edge. The surface of the adhesive portion 3 is coated or covered with pressure-sensitive adhesive. The adhesive portion 3 is mounted under the blade 2 (the up and down orientations are described as in the front view) and protrudes from the main body 1. The operation process of using is as follows: first pull out the tape and stick it onto the object 6 which is to be taped (usually a corrugated carton, FIG. 3), then hold the tape dispenser with your hand and pull it back. The tape roll is passively rotated to release the tape. After the first application of tape is completed, the operator manually adjusts the angle of the tape dispenser (as shown in FIG. 3, where the NO. 6 is the object to be taped), so that the blade 2 touches the back of the tape 41. The tape 41 should have been tightened at this time and bypassed the adhesive portion 3, so a pressure to the adhesive portion 3 will be generated. Thus the adhesive portion 3 will stick to the back of the tape as there is pressure-sensitive adhesive on the surface of the adhesive portion 3. When a torsion force is further applied as shown by the arrow in FIG. 3, the tape 41 is further tightened, so the pressure-sensitive adhesive on the surface of the adhesive portion 3 contacts the back of the tape more fully and sticks thereto tighter. The blade 2 penetrates the tape 41 further until it is completely cut off After the tape is cut, the back of the tape's end is adhered to the adhesive portion 3, so that no fluttering or re-adhesion occurs, and the sticky side of the tape remains outward. When applying a tape next time, as shown in FIG. 4, you don't need to look for the tape's end or pull out the tape's end by hand. You need only align the sticky surface of the tape's end directly to the object 6; press the tape's end onto the object 6 via the adhesive portion 3 of the tape dispenser, and then slightly lift the tape dispenser to separate the adhesive portion 3 from the back of the tape's end, and the tape's end sticks to the object 6. When the above-mentioned "lifting tape dispenser operation" is done, the tape's end may be separated from the object 6 and still kept on the adhesive portion 3. This situation should be avoided as much as possible. Therefor a right pressure-sensitive adhesive with a suitable initial adhesion force can be selected to act as the adhesive on the surface of the adhesive portion 3. Those skilled in the art can balance the initial adhesion force according to the following two points. First, after the tape is cut by the blade, the adhesive portion 3 can stick constantly and stably to the tape's end to make it difficult to fall off from the adhesive portion 3; second, after the above-mentioned "lifting tape dispenser operation", the adhesive force between the sticky side of the tape's end and the object 6 (usually a corrugated box) is greater than the adhesive force between the back of the tape's end and the adhesive portion 3. Since the corrugated box of the object to be taped 6 has a rough paper surface, its adhesion to the tape is very strong, while the back side of the tape is very smooth and relatively easy to peel off after being adhered to the adhesive portion 3. Therefore, it is a bit easy to achieve the above two points at the same time. In addition, the inventor found a small trick in repeated operation experiments: before performing the above-mentioned "lifting tape dispenser operation", pressing the tape's end against the surface of the object 6 and holding the tape dispenser for some slight squeezing or rotating (repeatedly slightly raising and pressing down) is beneficial for the tape's end to stick firmly to the object 6 and separate from the adhesive portion 3. If all the above measures are taken and the tape's end still cannot be separated from the adhesive portion 3, one can use fingers of the other hand to assist in pressing the furthest free portion 42 of the tape's end onto the object 6, as shown in FIG. 4. There is a certain gap between the edge of the blade and the object 6. If the gap is too small, you can slightly rotate the tape dispenser to lift the edge of the blade so that your finger(s) can reach and press the furthest free part 42 of the tape's end, which will certainly make the tape's end separated from the adhesive portion 3 and stuck to the object 6. When the tape's end is attached to the object to be taped 6 and the tape dispenser is raised, you could hold the tape dispenser and pull it rightwards to continuously release the tape. At this time, you can also press the released tape with your other hand, making it attached closely to the object 6. During continuous operation, because the tape's end is always kept in the state that the sticky side faces outward and able to be directly pressed onto the object 6 each time, the whole process is very smooth. Even if the other hand is occasionally required to assist in, it is only a simple auxiliary operation that does not require attention, which is very convenient and easy.

Regarding the relative positional relationship of the blade 2, the adhesive portion 3 and the main body 1:

The blade 2 is generally fixed on the main body 1, usually with a toothed edge, and its teeth should be designed with clearance around (number 9 in FIG. 4), that is, there is no object blocking in a certain space around, so that the teeth can fully penetrate the tape to cut it off (see FIG. 3). The blade 2 can also be made telescopic, which can slide relative to the main body 1. Normally, the blade 2 is retracted into the main body 1 due to an elastic mechanism. At this situation, there is no need to make a clearance design around the blade teeth. In the using state shown in FIG. 3, just push the blade out by hand. Regardless of the design of the blade 2, the positional relationship between the blade 2 and the adhesive portion 3 must be satisfied: when the tape is cut by the blade 2, the adhesive portion 3 can contact and stick to the back of the tape's end. In the basic embodiment of the present invention, as shown in FIG. 4, a clearance design is made under the teeth of the blade 2, that is, the gap 9 between the blade 2 and the adhesive portion 3. The width of the gap 9, namely, the distance D between the edge of the blade 2 and the edge of the pressure-sensitive adhesive on the adhesive portion 3 is generally set to 5-15 mm, preferably 10 mm, and this distance D is approximately equal to the length of the furthest free portion 42 of the tape's end after the tape is cut. The free portion 42 of the tape's end will not be stuck by the adhesive portion 3, and with the hardness and thickness of the commonly used tape in the market, if the length is within about 15 mm, there will be no flapping and sticking backward. Adopting the design of clearance to form the furthest free part 42 of the tape's end has the following advantages: after pressing the tape's end onto the object 6 as shown in FIG. 4, the furthest free part 42 of the tape's end, along with the tape's end as a whole, can easily be attached to the object 6. While the adhesive portion 3 does not stick to the back side of the free part 42 of the tape's end, so when the adhesive portion 3 is lifted, it is easy to peel off from the tape's end which could also be held down with a fingertip of the other hand. (Described foregoing).

The adhesive portion 3 is mounted under the blade 2 and protrudes from the main body 1. What is the specific extent of the protrusion referred to in the present invention? It should be understood that: in the operating position shown in FIG. 4, when the adhesive portion 3 is in close contact with the object 6 (with the tape's end in between), all other parts of the tape dispenser (including the blade 2 and the main body 1) and the tape roll 4 are all located above the object 6 without contacting it, so as to ensure that "the adhesive portion 3 can press the tape's end onto the object to be taped 6".

According to the above teachings and referring to the specific structures of the embodiments shown in the drawings of the present invention, those skilled in the art can understand how to design the relative positions of the blade 2, the adhesive portion 3 and the main body 1 and the size of each part. All modifications and variations of designs made by those skilled in the art in accordance with the principles of the present invention fall within the claimed protection scope of the present invention.

Pressure-sensitive adhesive is a kind of viscous compound, and essentially a viscoelastic body with both liquid viscosity and solid elastic properties. It is widely used in various easy-to-tear stickers, label's adhesives, and display glass's adhesives, and the sealing tape used for packaging. The pressure-sensitive adhesive is not easy to cure in the air and does not need to be cured after bonding, so it is easy to stick and tear. The bonding process is very sensitive to pressure. A lightly pressing or even lightly contact can make the adhesive adhere to the surface of the adherend, so it is called pressure-sensitive adhesive. The most widely used in the industry are rubber and acrylic ester pressure-sensitive adhesives, both of which can be used in the present invention. Acrylic ester pressure-sensitive adhesive is preferred, because it is used to make packaging tapes. Commonly used packaging tapes take BOPP (biaxially oriented polypropylene film) as the base material, and coat with acrylic ester emulsion evenly and then go through heating and drying to finally make it; Acrylic ester emulsion is a kind of emulsion polymerized under certain conditions by acrylic acid and acrylic esters, plus other auxiliary ingredients. The invention adopts acrylic pressure-sensitive adhesive to stick to the back of the tape's end, and the bonding effect is very good, and after multiple peeling and pasting cycles, it can still provide durable, stable and suitable bonding force. Pressure-sensitive adhesive is a high developed industrial product. There are various formulas and processes to achieve different effects. Those skilled in the art can choose according to their needs. The Pressure-sensitive adhesive with an initial adhesive force of about 12 # (steel ball) is preferred. There are many finished double-sided tapes made of pressure-sensitive adhesives on the market, which can be directly used in the present invention. For instance, cutting the pressure-sensitive double-sided tapes (preferably 0.1-0.2 mm thickness) into suitable sizes and attaching them close to the adhesive portion 3. While the tape dispenser of the present invention is used for taping, after each operation is completed, the adhesive portion 3 will stick to the back of the tape's end, and be peeled off when the next time operation is started, so the adhesive portion 3 and the back of the tape's end are repeatedly adhered and separated. After such a long cycle, the double-sided tape material on the adhesive portion 3 will eventually lose its viscosity. At this time, a new layer of double-sided tape can be attached to the original double-sided tape to restore the stickiness. The pressure-sensitive double-sided tape can be cut into suitably sized ones and made into consumables for users to stick by themselves, which is very convenient and low in cost. If the double-sided tapes covered on the adhesive portion 3 are with a lot of layers and too thick and affects the use effect, you can use a knife to shovel it all off and then stick a new one on again. In addition to adopting the finished pressure-sensitive double-sided tape, the surface of the adhesive portion 3 can also be directly coated with pressure-sensitive adhesive. The adhesive portion 3 is generally made of plastic or metal material. The pressure-sensitive adhesive layer can be formed by coating the surface of the adhesive portion 3 with acrylic ester emulsion and then drying.

Figure 5:
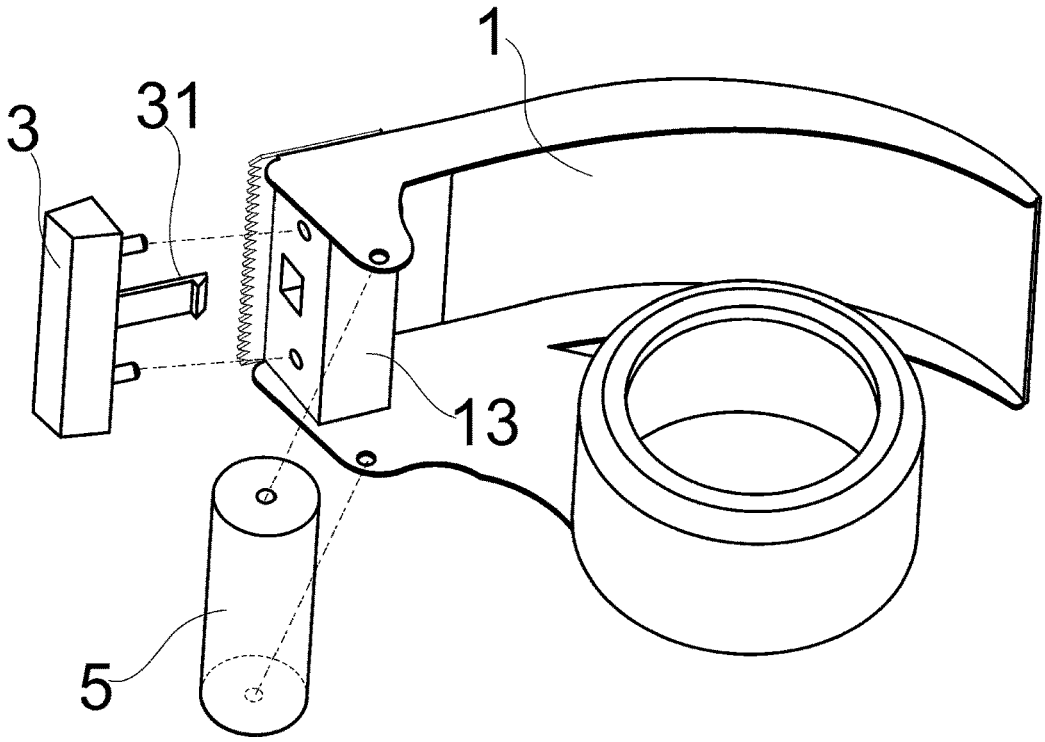
FIG. 5 is an exploded view of a second embodiment of the present invention.
Figure 6:
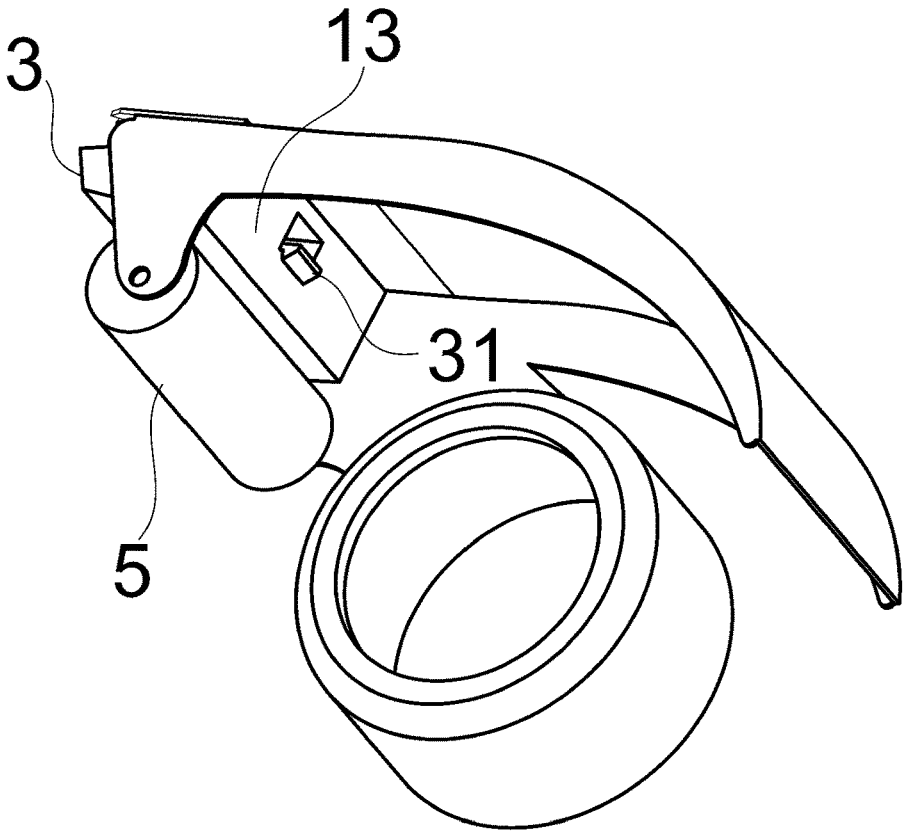
FIG. 6 is a perspective view of the second embodiment of the present invention.
Figure 7:
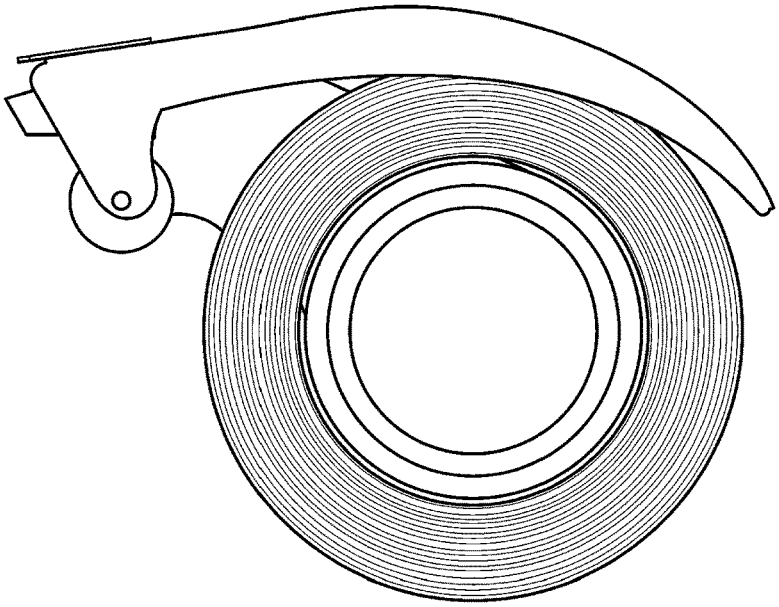
FIG. 7 is a front view of the second embodiment of the present invention.
Figure 8:
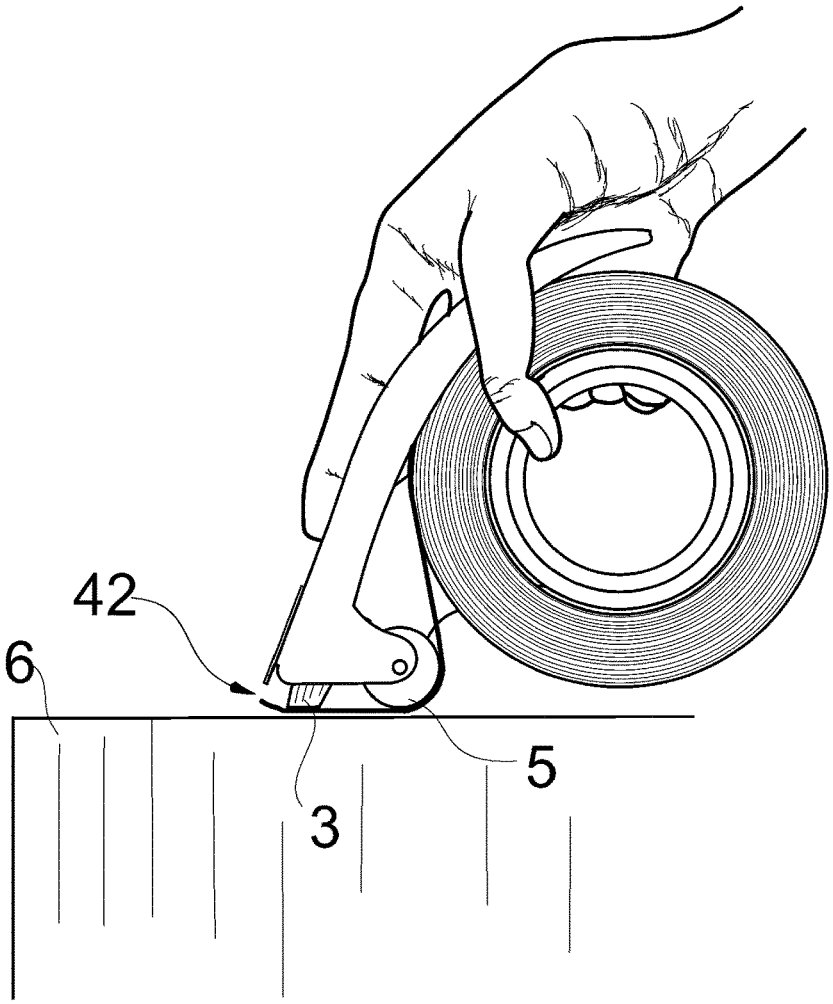
FIG. 8 is a schematic diagram of the use state of the second embodiment of the present invention.

The adhesive portion 3 and the main body 1 may be integrally formed, or the adhesive portion 3 may also be an independent part fixed on the main body 1. As a further improvement, the adhesive portion 3 and the main body 1 may be detachably connected. FIGS. 5-8 show a second embodiment of the present invention. In this embodiment, the adhesive portion 3 and the main body 1 are detachably connected in a snap-fit manner. As shown in FIG. 5, a mounting seat 13 is fixed in the main body 1 and provided with two circular blind holes and a square through hole. And the adhesive portion 3 is provided with two protruded cylinders and a cantilever hook 31. The two protruded cylinders on the adhesive portion 3 can be inserted into the two circular blind holes on the mounting seat 13; the cantilever hook 31 on the adhesive portion 3 can be inserted into the square through hole on the mounting seat 13 and pass through the through hole to mate with the inside surface of the mounting seat 13 to achieve snap-fit fastening. When disassembling, as shown in FIG. 6, just push the hook 31 from the inside of the tape dispenser to make the cantilever beam bent backward to unsnap the connection, and then the adhesive portion 3 can be pulled out. With the above-mentioned detachable connection way, the adhesive portion 3 can be quickly replaced by a new one after the pressure-sensitive adhesive thereon loses its viscosity. The adhesive portion can be provided as a consumable, and be coated or put on with the pressure-sensitive adhesive at the factory. The worn-out adhesive portions 3 can be collected and returned to the factory for getting new pressure-sensitive adhesive to restore viscosity, thus becoming recyclable. Of course, the detachable connection in this embodiment can also be fulfilled in other common ways, such as by magnetic attraction.

Figure 9:
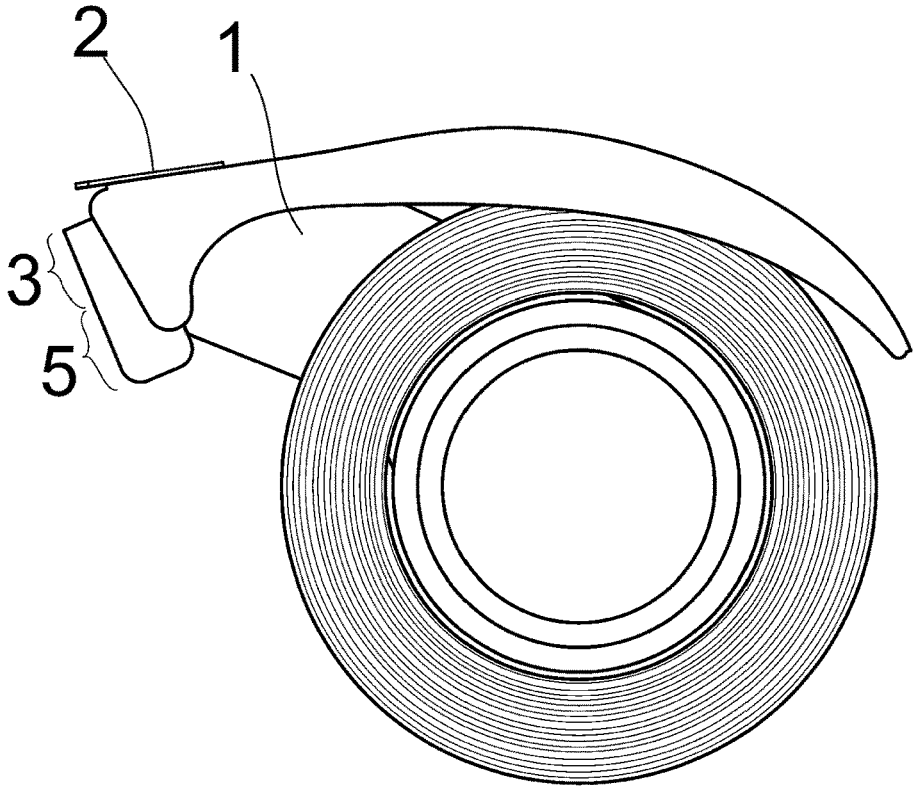
FIG. 9 is a front view of a third embodiment of the present invention.
Figure 10:
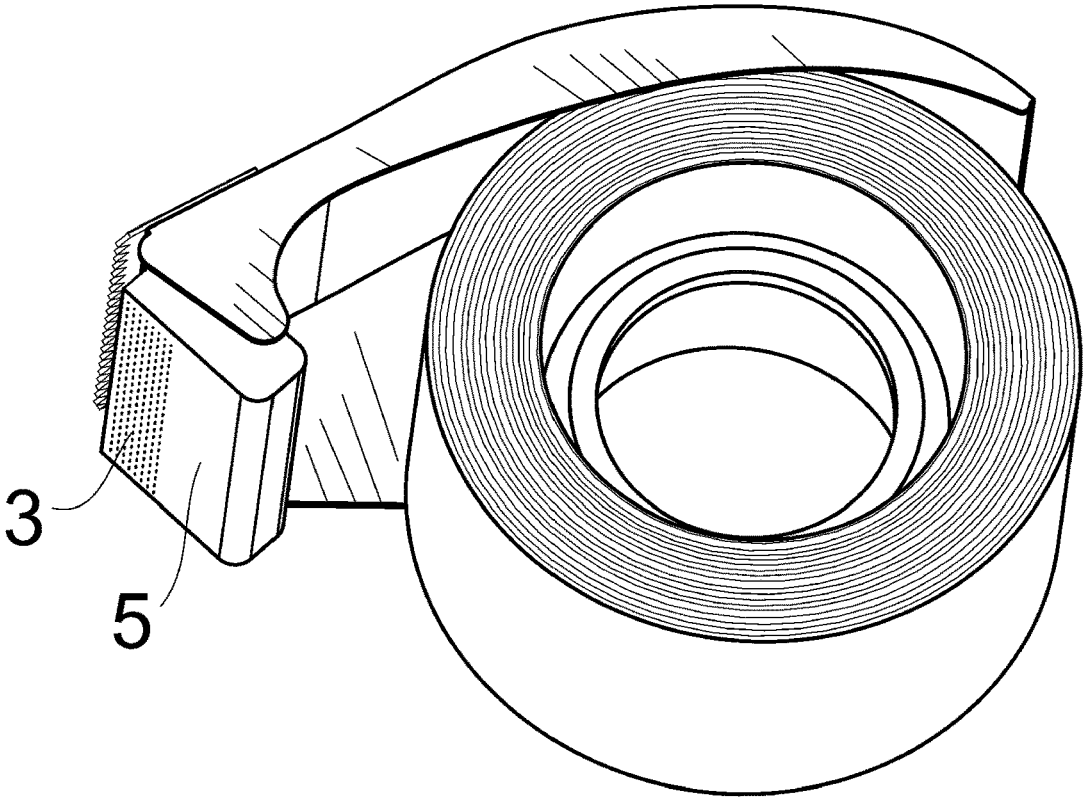
FIG. 10 is a perspective view of the third embodiment of the present invention.

The basic embodiment of the present invention still has defects: when using the tape dispenser to press the tape's end onto the object to be taped and then raise the tape dispenser, the tape's end may be separated from the object and still stay on the adhesive portion 3. In order to improve this situation, the adhesive tape dispenser of the present invention further includes a non-adhesive portion 5, see FIGS. 9 and 10 which are the third embodiment of the present invention. The non-adhesive portion 5 is provided under the adhesive portion 3. The non-adhesive portion 5 and the adhesive portion 3 are integrally formed as with coplanar outer surfaces, and both protrude from the main body 1. As shown in FIG. 10, the adhesive portion 3 has adhesive on the surface (indicated by dotted shading), and the non-adhesive portion 5 has no adhesive on the surface. The lower edge of the non-adhesive portion 5 can also play a role in guiding and flattening the dispensed tape, and can also press down the dispensed tape during the taping process to make it closer to the object which is to be taped, thereby facilitating sticking. The lower part of the non-adhesive portion 5 can be provided with a rounded edge, so that the dispensed tape can pass over the edge more smoothly and get lower possibility of being scratched or damaged when passing. After the tape is cut by the blade 2, the non-adhesive portion 5 contacts the back of the tape's end, and the tape's end is only stuck to the adhesive portion 3. In the next use, the non-adhesive portion 5 and the adhesive portion 3 can jointly press the tape's end onto the object to be taped. The front of the tape in this whole area will adhere to the object to be taped, but the back of the tape will only be stuck to the area of the adhesive portion 3. The area between the front of the tape and the object to be taped is much larger than the area between the back of the tape and the adhesive portion 3, so the adhesion force to the front of the tape is much greater than the adhesion force to the back of the tape. When the tape dispenser is raised, it can be ensured that the tape's end is separated from the adhesive portion 3 and remains tightly adhered to the object to be taped, and then the tape dispenser is held in hand and moved back to continue dispensing the tape. This embodiment makes it possible to perform continuous operation with one hand without the necessity for the other hand to assist in pressing the terminal of the tape's end every time the taping is applied.

Figure 11:
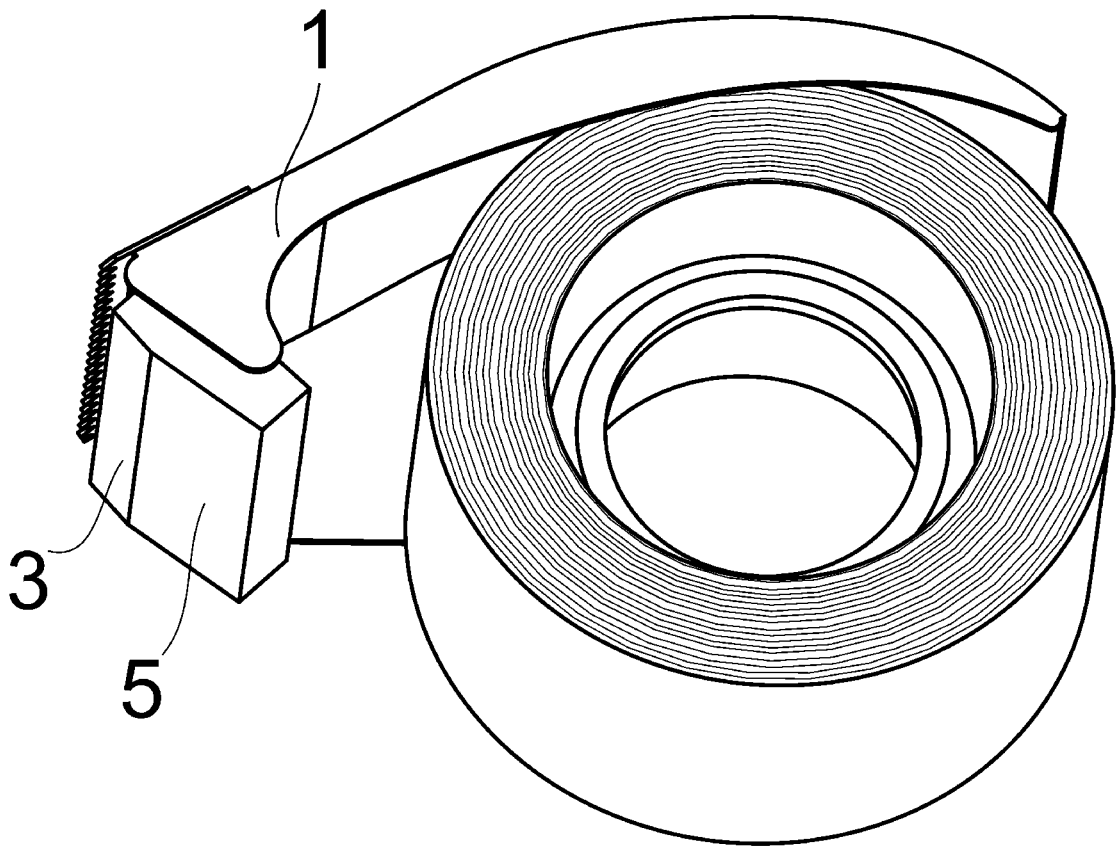
FIG. 11 is a perspective view of a fourth embodiment of the present invention.
Figure 12:
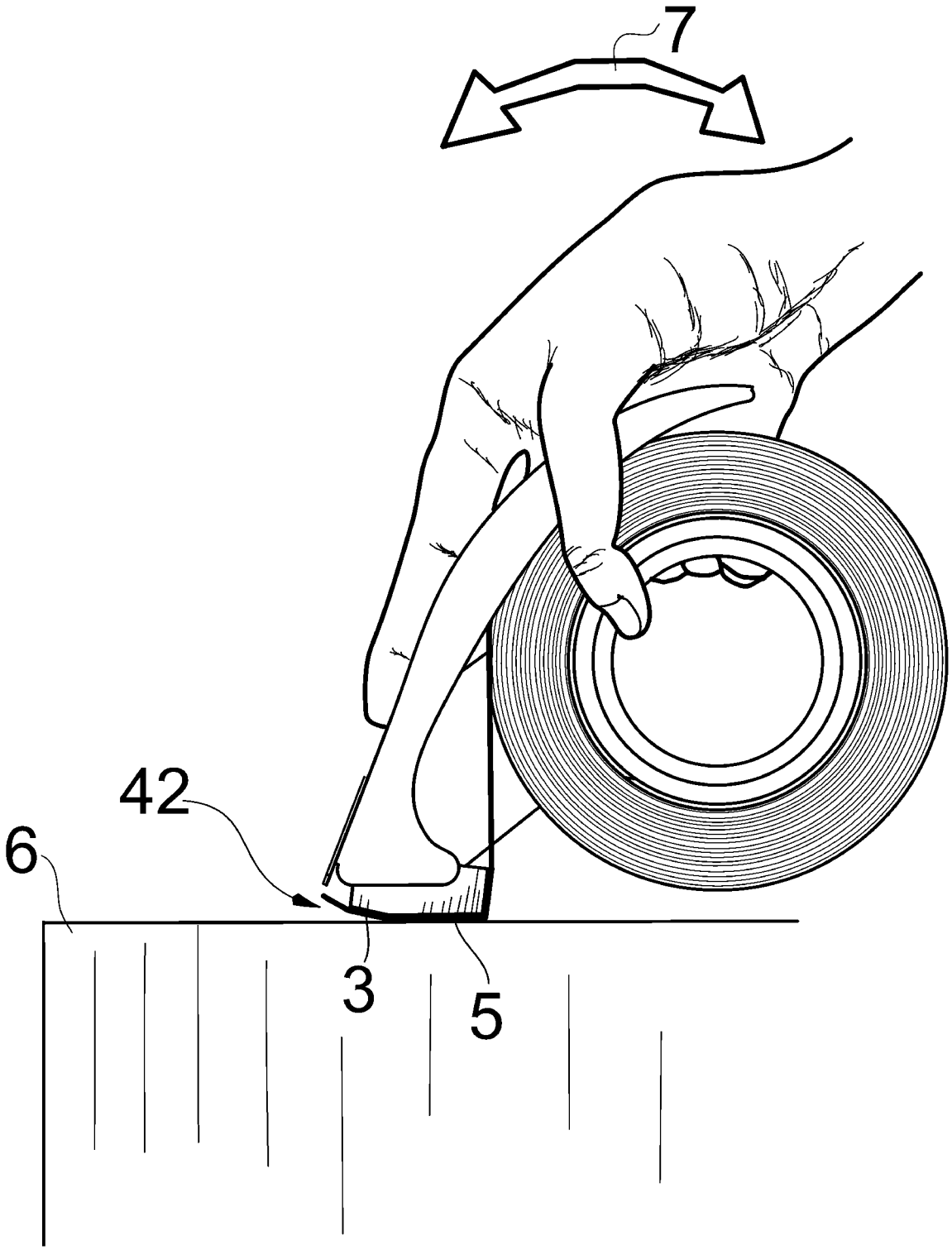
FIG. 12 is a schematic diagram of the use state of the fourth embodiment of the present invention.

FIGS. 11 and 12 show a fourth embodiment of the invention. The difference from the third embodiment is that the surfaces of the adhesive portion 3 and the non-adhesive portion 5 are not coplanar, and their intersecting ridge line is slightly protruded outward. It should still meet: the adhesive portion 3 and the non-adhesive portion 5 both protrude from the main body 1, that is: in the operating state shown in FIG. 12, the non-adhesive portion 5 and the adhesive portion 3 can both press the tape's end onto the object 6 to be taped, which can be achieved by slightly rotating the tape dispenser back and forth in the direction shown by the arrow 7. The entire area of the tape's end will be fully and firmly attached to the object 6, and then the tape dispense will be raised by putting up the tip of the blade first. The adhesive portion 3 certainly will be peeled off from the back of the tape's end, and the entire tape's end remains attached to the object 6, and then the tape dispenser is moved backward by hand to continue dispensing the tape. In this embodiment, one-handed continuous operation can also be fulfilled.

The second embodiment of the present invention shown in FIGS. 5-8 also includes the non-adhesive portion 5. The non-adhesive part 5 is a rotatable roller which is arranged on the main body 1 with a rotating shaft (not shown in the figure). Both the adhesive portion 3 and the non-adhesive portion 5 protrude from the main body 1, that is, in the operating state shown in FIG. 8, the non-adhesive portion 5 and the adhesive portion 3 can both press the tape's end onto the object to be taped 6. The tape's end in the entire area between the non-adhesive portion 5 and the adhesive portion 3 will fully adhere to the object to be taped 6, but the back of the tape's end is only stuck by the adhesive portion 3, and then the tape dispense will be raised by putting up the tip of the blade first, the adhesive portion 3 must be peeled off from the back of the tape's end, and the entire tape's end remains firmly attached to the object 6. Then the operator holds the tape dispenser and moves it backward to make it continue to dispense the tape. Meanwhile, the roller-shaped non-adhesive portion 5 can constantly press against and roll on the object 6, so as to flatten and compress the dispensed tape onto the object 6. To realize this operation, it is necessary to design an appropriate size of the roller 5 so that when the tape is dispensed onto the object to be taped 6 via rolling and pressing, other parts of the tape dispenser and the tape roll should not touch the object 6. In this embodiment, one-handed continuous operation can also be fulfilled.

Figure 13:
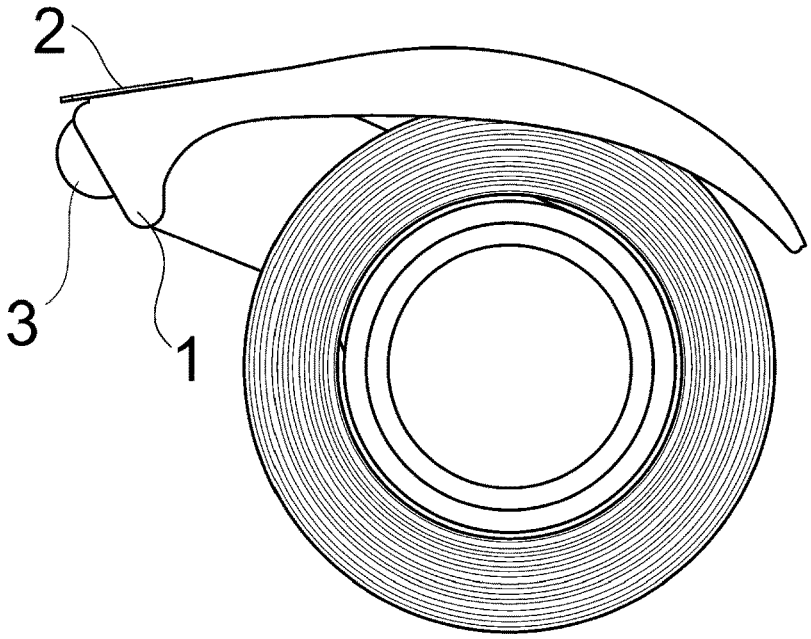
FIG. 13 is a front view of a fifth embodiment of the present invention.

FIG. 13 shows a fifth embodiment of the present invention. The difference from the basic embodiment is that the surface of the adhesive portion 3 is curved. The adhesive portion 3 may be a complete cylinder fixed on the main body 1, and an appropriate area of the protruded surface is treated to be sticky. The advantage is: while the angle of the tape dispenser is adjusted to make the blade 2 cut the tape, the back of the tape will gradually cover the arc-shaped adhesive portion 3 in a line contact manner until it is guided to the blade, which can make the operation process more stable, better experienced, and reduce the occurrence of tape's end wrinkles.

Figure 14:
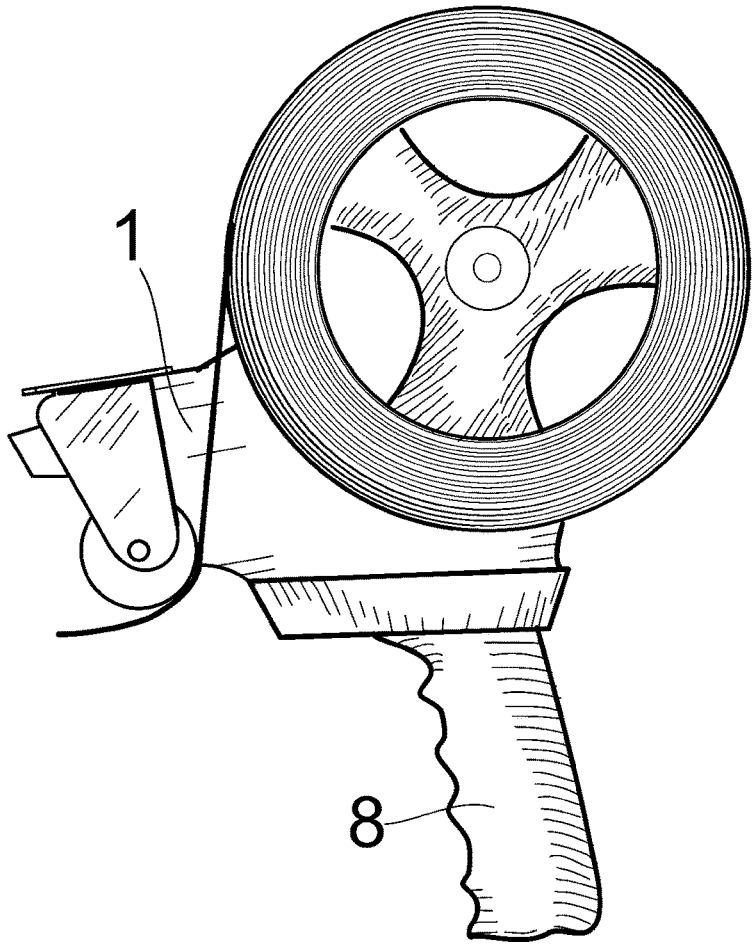
FIG. 14 is a front view of a sixth embodiment of the present invention.

Upon the teaching of the present invention, those skilled in the art can make some changes to the specific embodiments of the present invention. For example, the sixth embodiment shown in FIG. 14 has been changed, compared to the second embodiment, as follows: the shape and structure of the main body 1 are changed; the structure and position of the tape-holding portion are changed; and a gripping handle 8 is added. But the principle of the present invention is still applied, and it still belongs to the protection scope of the present invention.

What is claimed is:

1. A tape dispenser comprising:

a main body (1) which is provided with a tape-holding portion (11) for holding or accommodating a tape roll, which is rotatable to dispense tape;

a blade (2) which is positioned on the main body (1) and is used to contact and press the tape to cut it after the tape is dispensed;

an adhesive portion (3) coated or covered with a pressure-sensitive adhesive on the surface thereof, wherein the adhesive portion (3) is mounted under the blade (2) and protrudes from the main body (1); and a non-adhesive portion (5), having a flat surface without adhesive, positioned under the adhesive portion (3) and also protruding from the main body (1), wherein the total surface area of the adhesive portion (3) and the non-adhesive portion (5) is much greater than the surface area of the adhesive portion (3) alone, such that after the tape is cut by the blade (2), both the adhesive portion (3) and the non-adhesive portion (5) can come into contact with the back of the tape's end, with only the surface of the adhesive portion (3) adhering to the back of the tape's end, and during subsequent use, both the non-adhesive portion (5) and the adhesive portion (3) jointly press the tape's end firmly onto an object to be taped (6), so that the tape's end adheres to the object to be taped (6) and is peeled off from the adhesive portion (3) when the tape dispenser is lifted by a user.

2. The tape dispenser according to claim 1, wherein the adhesive portion (3) is provided with a cantilever hook (31)

and detachably connected to the main body (1) in a snap-fit manner, wherein the cantilever hook (31) on the adhesive portion (3) can penetrate a through hole on a mounting seat (13) fixed in the main body (1) to mate with the inside surface of the mounting seat (13) to achieve a snap-fit fastening, and can be pushed out by the user from the inside of the main body (1) to remove the adhesive portion (3).

3. The tape dispenser according to claim 1, wherein the blade (2) is with a toothed edge and mounted on the main body (1), wherein there is a gap of 5-15 mm in width between the blade (2) and the adhesive portion (3).

* * * * *